US005782386A

United States Patent [19]

Lester

[11] Patent Number: 5,782,386

[45] Date of Patent: Jul. 21, 1998

[54] DISPENSING CLOSURE FOR A SQUEEZABLE CONTAINER

[76] Inventor: William M. Lester, 4389 White Cedar La., Delray Beach, Fla. 33445

[21] Appl. No.: 720,676

[22] Filed: Oct. 2, 1996

[51] Int. Cl.[6] ..... B67B 5/00

[52] U.S. Cl. ..... 222/153.14; 222/493; 222/495; 222/212

[58] Field of Search ..... 222/153.14, 493, 222/495, 549, 525, 212

[56] References Cited

U.S. PATENT DOCUMENTS

| | | |
|---|---|---|
| 963,836 | 7/1910 | Varlie . |
| 1,721,666 | 6/1929 | Lee . |
| 3,165,242 | 1/1965 | Jackson . |
| 3,490,658 | 1/1970 | Schwartzman . |
| 3,817,284 | 6/1974 | Daugherty . |
| 3,887,116 | 6/1975 | Ishikawa et al. . |
| 4,203,536 | 5/1980 | Lester . |
| 4,253,588 | 3/1981 | Lester et al. . |

FOREIGN PATENT DOCUMENTS

| | | |
|---|---|---|
| 2 364 168 | 9/1976 | France . |

*Primary Examiner*—Gregory L. Huson
*Attorney, Agent, or Firm*—William Squire

[57] ABSTRACT

An annular tapered valve seat and mating valve on a valve member are secured in fluid communication with a container interior. Fluid in the container under pressure axially displaces the valve from its seat, flows through the interface between the valve and seat and is discharged through a transverse conduit in the valve member and an axial central conduit in the valve member stem which is sealingly engaged with a bore in the housing with annular ribs for guiding the stem. A tapered valve chamber wall engages a shoulder on the valve member for limiting the axial displacement of the valve member to retain fluid in the interface in the absence of container pressure above ambient. The fluid in the interface precludes ambient air passing to the container interior so that a negative pressure in the container results in ambient air pressure forcing the valve to its closed position. A disc-like handle knob is attached to the stem and overlies the stem and housing to form a manual grip for rotating the valve member to open and locked states formed by a ridge on the shoulder which engages the chamber wall in the locked state.

15 Claims, 2 Drawing Sheets

DISPENSING CLOSURE FOR A SQUEEZABLE CONTAINER

The present invention relates to dispensing closures for squeezable containers.

Of interest are commonly owned U.S. Pat. Nos. 4,203,536 and 4,253,588.

The present invention is an improvement of the invention disclosed in U.S. Pat. No. 4,203,536.

Automatic dispensing closure valves for squeezable containers include valves which open in response to greater than ambient pressure inside the container. The pressure forces the fluid in the container through the valve, opening the valve, then through a discharge orifice to the ambient. To close the valve, the valve either has to be manually returned to the closed position or, in some configurations, automatically returns to the closed position.

In the latter valves, various spring devices are provided which are placed under spring bias pressure when the valve opens. Upon reduction of pressure in the container to ambient or less, the spring bias pressure closes the valve. While it is more desirable to provide automatic closure of the valve the additional spring elements add to the cost and complexity of the apparatus.

In the closure disclosed in the aforementioned U.S. Pat. No. 4,203,536, the valve automatically returns to the closed valve condition based on pressure differentials between a container interior and the ambient atmosphere. As the disclosed pliable container is compressed to reduce its volume and force its liquid contents out of the closure conduit through the valve, the container forms a low pressure in its interior when it resiliently returns to its normal expanded state. The higher ambient atmospheric pressure forces the valve closed due to a sealing action of the liquid from the container that is between the valve member and its mating seat which are complementary conical shapes.

To preclude accidentally opening the closure by compression of the container as described above, a locking arrangement is provided which locks the valve member closed. The locking action requires the valve member to be rotated between open and closed positions. A relatively small arrow on the valve member stem upper surface is raised somewhat above the stem upper surface to indicate the open-closed position of the valve member relative to indicia on the valve body.

The valve member stem projects vertically above the conical valve member. To permit liquid to escape to the ambient, a discharge channel is formed in the side surface of the valve stem in communication with the valve body chamber in which the valve member is located. The channel is formed on the stem side surface so as to not interfere with the closed-open position indicating arrow. Because the stem is relatively small in diameter, the arrow is also relatively small.

The arrow projecting above the stem is intended to serve as a finger gripping device for rotating the stem and valve member attached thereto to the open and locked positions. The arrow, however, needs to be relatively small to accommodate the liquid dispensing port. Due to the relatively small size, i.e., length and height of the arrow, in practice it is difficult to grasp the arrow in order to rotate the valve and as a result, this device has met with little success. To provide a larger gripping device, the arrow would overlie the channel, and would interfere with the dispensing from the channel. The arrow is required in order to give directions to the user as to the position of the valve in the open and closed states The present inventor recognizes that a conflict is presented in solving this problem in that the gripping device needs to be rotated and that the dispensing channel should be small in diameter to control the liquid flow to a small stream. Such a stream could be interfered with if the gripping device is made larger.

The above problem is resolved with a closure for dispensing a fluid stored in a squeezable resilient container according to the present invention which comprises a housing having a valve cavity and means for securing the housing in fluid communication with the container interior. An annular tapered valve seat is in the cavity. A valve member includes a tapered valve and a stem, the valve member having a bottom surface, the valve having a surface complementary to the seat for providing a substantially fluid tight seal in a seated closed valve position and for providing a fluid passage at the interface between the valve member and the seat in an open valve position. The valve stem upstands from the valve in the cavity along an axis and has a top portion in communication with the ambient atmosphere, the valve member being rotatably secured to the housing.

A disc-like handle knob is secured to the valve stem top portion for manual gripping by a plurality of fingers for rotating the stem about the axis, the handle overlying the valve stem and a portion of the housing.

The interface is for being positioned in fluid communication with the stored fluid so that fluid forced against the bottom surface displaces the valve member to the open valve position along the axis and the fluid enters into and forms a seal with the interface.

The valve member has a fluid receiving conduit transverse to the axis in fluid communication with the cavity and interface, and a vertical central fluid discharge conduit passes through the valve stem from the fluid receiving conduit along the axis to the ambient atmosphere through the handle knob.

Valve member displacement limiting means has a locked state and an unlocked state and is coupled to the housing and valve member for limiting the distance the valve member is permitted to axially displace to an open valve position from the closed valve position to provide a maximum clearance in the interface between the valve member and seat such that fluid in the interface tends to effectively seal the interface from passing ambient air therethrough when the container interior pressure is less than ambient pressure to force the valve member to its closed valve position.

Locking means are provided for locking the valve member in the closed valve state in response to rotation of the valve member.

According to one aspect of the present invention, the housing cavity has a bore aligned with the seat on the axis, the stem passing through the bore, at least one annular rib which is formed as one piece and integral with the housing extends radially inwardly from the housing in the bore for sealingly engaging the stem. According to a further aspect, the rib also serves to guide the stem during axial displacement of the valve and stem between the open and closed states.

IN THE DRAWING

Figure 3:
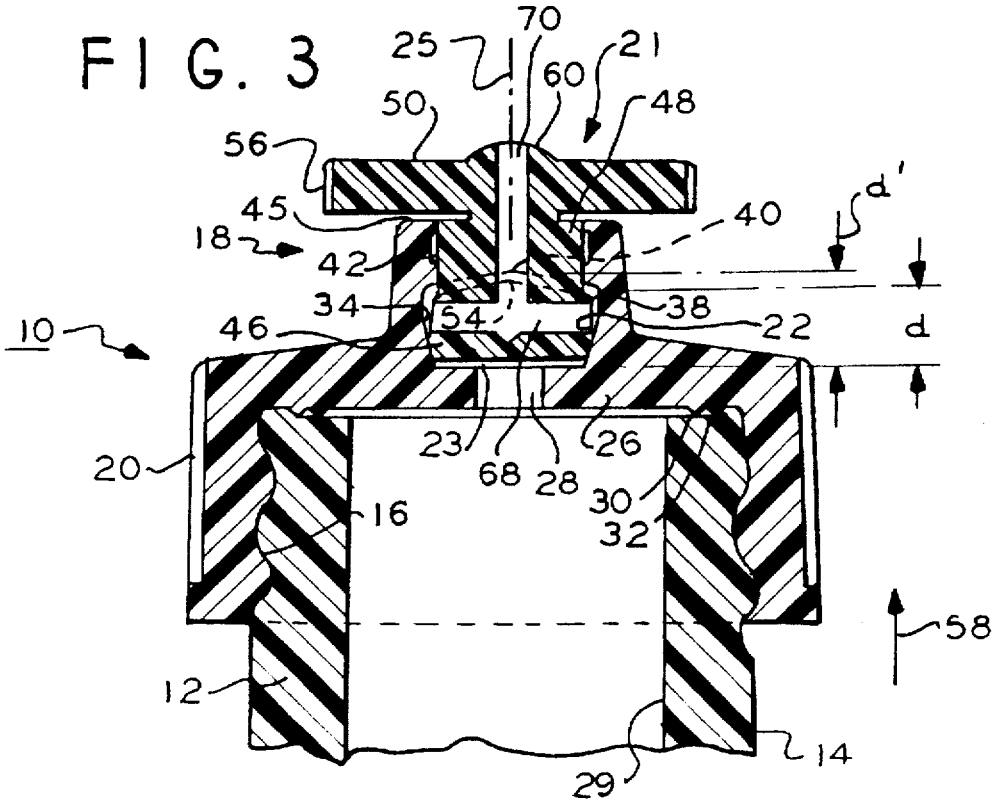
FIG. 3 is a sectional side elevation view of the closure of FIGS. 1 and 2 showing the valve in the unlocked closed valve position.
Figure 4:
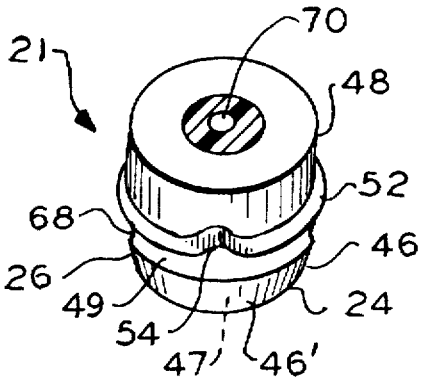
FIG. 4 is an isometric fragmented view of the valve member of the closure of FIGS. 1 and 2 with the handle broken away for clarity of illustration.
Figure 4A:
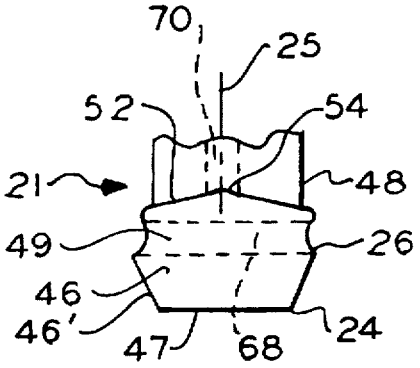
Figure 6:
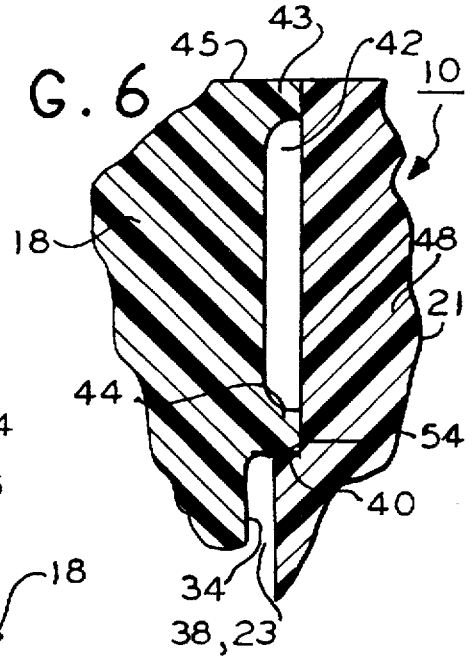
Figure 5:
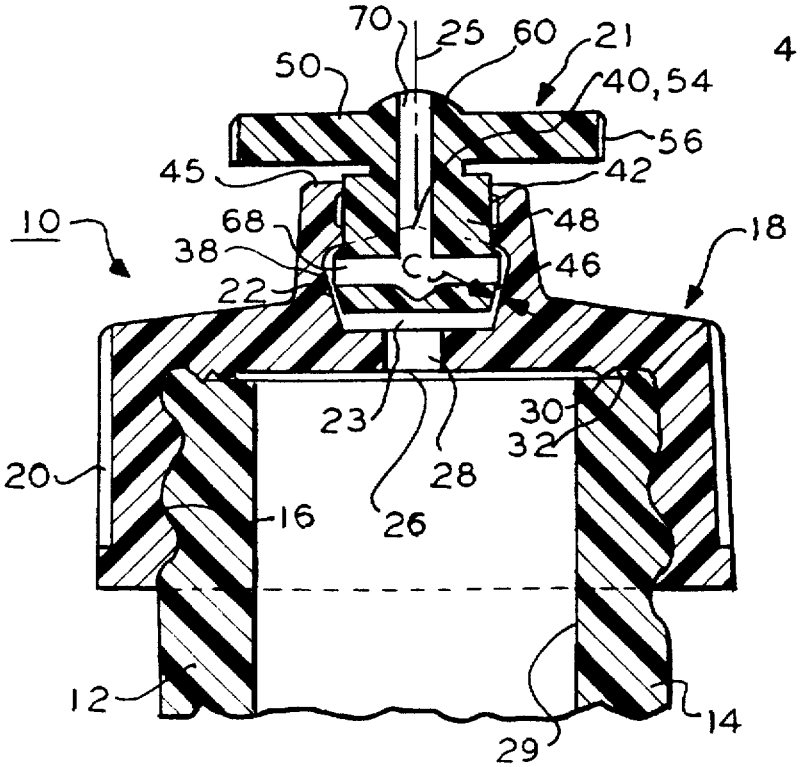
Figure 5:
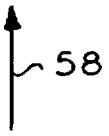

FIG. 4*a* is a side elevation view of the valve member stem portion of FIG. 4 showing the locking arrangement;

FIG. 5 is a sectional side elevation view of the closure similar to the view of FIG. 3 but with the valve in the open position; and FIG. 6 is a sectional view of a portion of the closure and valve in the closed locked position.

Figure 1:
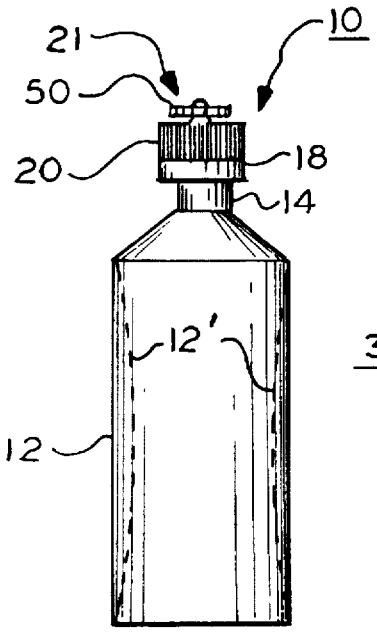
FIG. 1 is an elevation view of a closure embodying the present invention mounted on a squeezable container.

In FIG. 1, the closure 10 embodying the present invention is illustrated as being usable with a plastic squeezable container 12 for various fluids, including liquids, pastes and the like. The container 12 is of thermoplastic molded pliable material. By depressing the container 12 at the sides, the container depresses or "squeezes" as shown dashed at 12'. The sides have memory, and being resilient, return to their original state (solid lines) when released. The container 12 and closure 10 generally have the structure of the closure disclosed in the aforementioned U.S. Pat. No. 4,203,536 incorporated by reference herein.

The container squeezed condition increases the pressure in the container above ambient atmosphere and forces the contents from the container through the closure 10 discharge orifice as will be described. The closure 10 has a locked state, FIG. 6, with the valve closed, FIG. 3, to prevent the contents of the container from discharging unintentionally in case of accidental squeezing as might occur during transit.

Container 12 has a threaded throat 14 on which the closure 10 is mounted via internal threads 16, FIG. 3, formed in housing 18. The closure 10 comprises a housing 18 and a valve member 21. The housing 18 external peripheral surface has serrations 20 to aid the user to mount and demount the closure 10 on the container 12. Any other fastening devices may be used instead of threads as may be convenient for a particular implementation. Housing 18 may be formed of any suitable flexible material.

Internal to housing 18 is a cavity 23 in which is a tapered valve seat 22. Seat 22 preferably is frusto-conical with its smallest diameter 24, FIGS. 4 and 4*a*, closest to container 12 and its largest diameter 26 distal the container 12. The slope of the seat 22 surface is about 10° with the vertical axis 25. This angle is not critical and can vary somewhat from this value which is given by way of example. Seat 22 surrounds and forms a side wall of cavity 23. Immediately above seat 22 is side wall 34 of cavity 23.

Conduit 28 is centrally positioned on axis 25 within the cavity 23 bottom wall 26 and provides fluid communication between the cavity 23 and the container 12 interior 29. A pair of spaced annular container sealing ribs 30 and 32 with a triangular sectional shape depend from the lower surface of housing 18 interior the threads 16. The ribs 30 and 32 are one piece integrally molded with the housing which is preferably molded thermoplastic material. The ribs 30 and 32 engage the upper lip of the container 12 for sealing cavity 23 to the container interior 29. In the alternative, a gasket ring (not shown) may be used to seal the lip of the container to housing 18.

Figure 2:
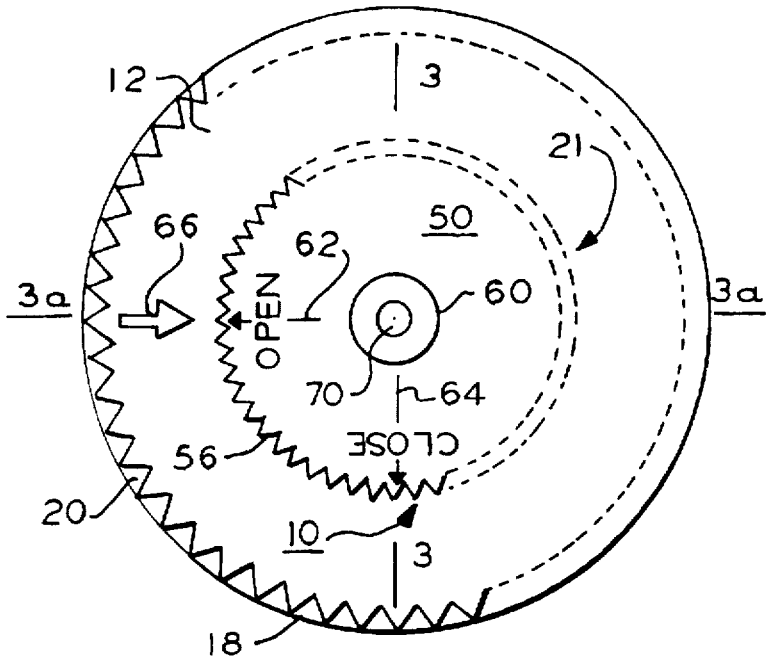
FIG. 2 is a top plan view of the closure of FIG. 1.

The upper edge of seat 22 terminates at circular cylindrical upstanding side wall 34 to form an interior chamber 38 in the cavity 23. Chamber 38 has an upper ceiling wall 40 which terminates at side wall 34. Wall 40 slopes for providing locking action as will be described. Wall 40 along lines 3—3, FIG. 2, is spaced a minimum distance d (the height of wall 34) from bottom wall 26. Wall 40 along lines **3*a*—3*a* FIG. 2, is spaced a maximum distance d' from bottom wall 26, lines 3*a*—3*a* being 90° from lines 3—3. Wall 40 slopes smoothly from distance d to distance d' in a continuous smooth downwardly facing shoulder. Distance d' is greater than distance d for providing locking and unlocking action of the valve member 21** as will be explained.

A cylindrical longitudinal stem guide bore 42 concentric with axis 25 is formed in housing 18 open to cavity 23 and chamber 38 at its lower end and to the ambient atmosphere at its upper end. Bore 42 is coaxial with the seat 22 and conduit 28 on axis 25.

In FIG. 6, a pair of sealing ribs 43 and 44 are one piece molded with the housing 18. The ribs 43 and 44 are preferably identical and are somewhat pliable to from a seal with the valve member stem to be described below. The ribs 43 and 44 extend radially inwardly into the bore 42 from the side wall of the bore 42. Rib 42 is adjacent to the housing 18 top surface 45.

Valve member 21, FIGS. 4 and 4*a*, has a valve 46 which is mounted in, mates with and is complementary shaped with seat 22 and a valve stem 48 which is in chamber 38 and extends into the ambient atmosphere through bore 42. When fully seated in seat 22, the valve 46 is closed and no fluid can pass in the interface between the valve 46 and seat 22. The bottom surface 47 of valve 46 is flat and is spaced from the housing bottom wall 34 when the valve is closed, FIG. 3. The tapered surface 46' of valve 46 terminates at its upper extremity in a circular cylindrical portion 49. Shoulder 52 tapers downwardly and radially outwardly from its more central portion adjacent to the stem 48 to the cylindrical portion 49. The taper of shoulder 52 is similar to the taper in ceiling wall 40 of chamber 38 which tapers in complementary fashion.

Two radially outwardly and upwardly extending ridges 54 (one shown) are on shoulder 52 at diametrically opposite sides of valve 46. These ridges are molded integral with valve 46 in this example. The ridges 54 slope gradually along the shoulder 52 to a maximum distance from bottom surface 47.

When valve 46 is seated in seat 22 in the closed valve condition, FIG. 3, and the ridges 54 are aligned along lines 3α—3α, FIG. 2, there is a clearance distance between the ridges 54 and the ceiling wall 40. This clearance permits the valve member 21 to displace in the direction of arrow 58. Wall 40 forms a vertical upward displacement stop for valve 46 limiting its displacement from seat 22 to a certain value whose importance will be explained later.

When the valve member 21 is rotated 90° so that the ridges are aligned with imaginary lines 3—3, FIG. 2, the ridges 54 engage ceiling wall 40 in the closed valve state. Distance d is made that value such that there is a slight interference fit between ridges 54 and ceiling wall 40 when at this angular position and the valve 46 is fully seated. Since the valve 46, ridges 54 and housing are all made of a somewhat pliable material such as polypropelene or polyethelene, the slight interference fit forces and locks the valve 46 in the closed valve position.

Accidentally applied elevated pressure from within the container interior 29 will not displace the valve 46 from the closed valve position. The valve member is rotatable in any direction and thus it does not matter in which direction valve 46 is rotated. When ridges 54 are aligned with lines 3α—3α the valve may open, and when aligned with lines 3—3, the valve 46 is locked closed.

Circular cylindrical stem 48 is integral with valve 46 and extends centrally upwardly from valve 46 concentric with axis 25. Stem 48 axially displaces along axis 25 in bore 42. Stem 48 is closely engaged in sealing contact with the ribs 43 and 44, FIG. 6, an amount sufficient to prevent fluid from seeping therebetween but not so tight so as to prevent stem 48 from displacing in bore 42. Stem 48 serves as a guide for valve 46 to ensure that valve 46 seats properly in seat 22.

A circular disc-like handle knob 50, FIG. 2, is secured to stem 48 via a narrow neck portion. The knob 50 has knurls or serrations 56 on its outer peripheral surface. A raised central portion 60 is on knob 50. Indicia 62 and 64 in the form of text and arrows are on knob 50 to indicate respectively the open and closed positions of the knob relative to arrow indicia 66 on the housing 18. The indicia are molded integral onto the respective surfaces, raised or depressed as desired.

A transverse fluid conduit 68 extends through stem 48 in circular cylindrical portion 49. An additional transverse conduit (not shown) normal to conduit 68 may be further provided according to a given implementation. The stem 48 side wall is circular cylindrical above the valve 46 and below the shoulder 52. The conduit 68 terminates in chamber 38. The conduit 68 extends through the stem 48 normal to axis 25.

A vertical discharge conduit 70 is aligned on axis 25 and is in fluid communication with the conduit 68 at its lower end and with the ambient at its upper end. The conduit 70 passes centrally through the knob 50. Any fluid under pressure in chamber 38 exits the chamber to the ambient through the conduits 68 and 70 and is formed into a relatively small diameter stream with the container inverted.

Rotation of the knob 50 positions the valve 46 in the desired locked or unlocked position, respective lines 3—3 or 3a—3a, FIG. 2. In FIG. 2, the knob 50 is shown in the unlocked (open) position of FIG. 3. The valve 46 is seated on seat 22, however, and is closed.

FIG. 5 shows the valve opened from the position of FIG. 3 ready to dispense fluid (liquid). When rotated 90° from this position to the locked state, the valve cannot be displaced to the position of FIG. 5 from the position of FIG. 3. When locked, ridges 54 abut ceiling wall 40 and force valve 46 tightly into seat 22. Pressure within container 12 can not open the valve.

The inverted assembly of FIG. 5 discharges a fluid (not shown) as the container 12 is squeezed to increase the internal pressure above ambient. The fluid flows through conduit 28 impinges against valve 46 bottom surface 48, forcing the valve open in the direction of arrow 58. Fluid flows into the interface between seat 22 and the tapered valve surface 46' of valve 46. Because the conduit 28 is centrally positioned and of sufficient flow capacity for the particular fluid, fluid enters into the valve interface in an annular flow completely surrounding the tapered surface 46' of valve 46 and filling the entire interface.

This occurs because the clearance C between seat 22 and valve 46, FIG. 5, is sufficiently small with respect to the volume of fluid flowing and its viscosity. That is, the internal pressure at the bottom 48 of valve 46 is sufficiently high with respect to the entire flow area at the interface, such that fluid tends to enter the entire circumferential area of the interface as the fluid emerges from conduit 28.

These relationships can be readily determined empirically.

The distance d' (FIG. 3) is chosen to provide sufficient clearance space for ridges 54 so that clearance C (FIG. 5) does not exceed a certain value. That value is one which permits the valve-seat interface to be filled with the fluid and remain filled in an annular continuous ring around valve surface 46' during the container 12 squeezing and subsequent release actions.

It is to be understood that the clearance C is also a function of the fluid viscosity. A more viscous fluid, for example, heavy oil, flows less readily than a less viscous fluid such as water. Thus the interface flow area should be made greater for more viscous fluids than less viscous fluids to form the fluid sealing action. The interface will remain sealed longer (with the container interior pressure at ambient) with a more viscous fluid than with a less viscous fluid for a given clearance. The time the fluid should remain in the interface as a seal is a matter of a few seconds until the valve 46 closes as the container interior 29 pressure becomes less than ambient. The amount of fluid in the interface is not critical as long as the fluid forms a continuous annular ring about valve 46 so that ambient air does not immediately return to the container interior without first closing valve 46.

This fluid ring acts effectively as a seal to ambient air attempting to return to the container 12 interior via the interface 68. Since air can not easily return via this route due to the presence of the fluid in the interface, the greater pressure forces the valve 46 against seat 22, closing the valve automatically and without any spring bias devices. Of course, after the valve 46 is seated, the higher ambient pressure may tend to seep air through the closed interface 68 to equalize the pressure in the container 12 interior with the ambient since the seal may not be a perfect seal. This is acceptable. The valve will be effectively closed and will remain in that position until the container is again squeezed. To prevent accidental discharge it can be locked, but that is not essential to placing the valve in the closed position. By way of example, for a mean seat diameter of 7/16 inches and a fluid viscosity of about same as S.A.E. 40 oil, the clearance C can have a value of about 1/64 inches.

Thus wall 40 acts as a displacement limiting device for valve 46. This action ensures automatic closure of the valve upon dissipation of back pressure (greater than ambient) in conduit 28 and container interior and upon creation of a negative pressure (less than ambient) in conduit 28. This pressure shift results from the natural return of container 12 from the squeezed (dashed—FIG. 1) condition to the stable condition (solid—FIG. 1).

The knob 50 is dimensioned to overlie a portion of the housing 18 so that the indicia thereon are adjacent when viewed from above in a direction opposite direction 58. The discharge conduit 70 receives fluid from conduit 68 via chamber 38. The conduit 70 being central forms a small stream of fluid during discharge. The knob when rotated does not interfere with the discharge stream. The knob is sufficiently large so as to be gripped by several fingers of a person and is readily grasped for locking and unlocking the valve. The serrations on the periphery of the knob and housing permit good locking and ease of unlocking of the valve.

It will occur to one of ordinary skill that various modifications may be made to the disclosed embodiment without departing from the scope of the appended claims.

What is claimed is:

1. A closure for dispensing a fluid stored in a squeezable resilient container comprising:

a housing having a valve cavity;

means for securing the housing in fluid communication with the container interior;

an annular tapered valve seat in said cavity;

a valve member including a tapered valve and a stem, the valve member having a bottom surface, the valve having a surface complementary to said seat for providing a substantially fluid tight seal in a seated closed valve position and for providing a fluid passage at the interface between said valve member and said seat in an open valve position;

said valve stem upstanding from said valve in said cavity along an axis and having a top portion in communication with the ambient atmosphere, said valve member being rotatably secured to said housing;

a disc-like handle knob secured to said valve stem top portion for manual gripping by a plurality of fingers for rotating said stem about the axis, said handle overlying said valve stem and a portion of said housing;

said interface for being positioned in fluid communication with said stored fluid so that fluid forced against said bottom surface displaces said valve member to the open valve position along said axis and said fluid enters into and forms a seal with said interface;

said valve member having a fluid receiving conduit transverse to said axis in fluid communication with said cavity and interface, and a vertical central fluid discharge conduit passing through said valve stem from said fluid receiving conduit along said axis to the ambient atmosphere through said handle knob;

valve member displacement limiting means having a locked state and an unlocked state coupled to said housing and valve member for limiting the distance said valve member is permitted to axially displace to an open valve position from the closed valve position to provide a maximum clearance in said interface between the valve member and seat such that fluid in said interface tends to effectively seal said interface from passing ambient air therethrough when the container interior pressure is less than ambient pressure to force said valve member to its closed valve position; and locking means for locking the valve member in the closed valve state in response to rotation of the valve member.

2. The closure of claim 1 wherein said housing cavity has a bore aligned with said seat on said axis, said stem passing through said bore, at least one annular rib which is formed as one piece and molded integral with the housing extending radially inwardly from said housing in said bore for sealingly engaging said stem and for guiding the stem during placement of the valve in the open and closed states.

3. The closure of claim 1 wherein said at least one annular rib includes a plurality of ribs in axially spaced position in said bore.

4. The closure of claim 3 wherein said ribs define a cylindrical bore and said stem has a circular cylindrical peripheral surface engaged with said ribs.

5. The closure of claim 2 wherein said handle knob and said housing each having an outer peripheral surface formed with serrations and mating indicia for identifying said open and locked positions.

6. The closure of claim 1 wherein said valve member has an annular shoulder with an upstanding ridge in a given circumferential position, said housing including an upper ramped wall in the cavity spaced a first distance from said shoulder at one annular location an amount sufficient to axially lock said valve member in the closed position when said ridge is at said one location and a second distance greater than said first distance at a second annular location an amount sufficiently great to permit said valve member to displace to said open valve position when said ridge is at said second annular location.

7. The closure of claim 1 including a cylindrical portion intermediate the valve and stem, said transverse fluid receiving conduit passing through said cylindrical portion.

8. A fluid dispensing closure for a squeezable resilient container which after squeezing tends to return to a normal stable condition creating a pressure lower than atmospheric within the container interior comprising:

a housing having a cavity passing therethrough;

means for securing the housing to said container in fluid communication with the container interior, valve means including a tapered valve member and a tapered mating valve seat on said housing in said cavity having open and closed valve positions for fluid communication with said container interior, said member including a stem and being rotatably and axially movably secured to the housing seat for rotation about and displacement along an axis and responsive to a pressure greater than atmospheric in said container for displacing to the open valve position permitting fluid in said container to enter the interface between said member and said seat;

said valve stem upstanding from said valve member in said cavity along said axis and having a top portion in communication with the ambient atmosphere;

an annular handle knob secured to said valve stem top portion for manual gripping by a plurality of fingers for rotating said stem about the axis, said handle knob overlying said valve stem and a portion of said housing;

said valve member having a fluid receiving conduit transverse said axis in fluid communication with said cavity and interface, and a vertical central fluid discharge conduit passing through said valve stem from said fluid receiving conduit along said axis to the ambient atmosphere through said handle knob;

valve member displacement limiting means coupled to said housing and valve member for limiting the axial displacement of said member from the closed to open valve positions to provide a maximum clearance between said member and said seat at that value at which fluid in said interface tends to effectively prevent ambient air from passing through said interface to said interior during the return of the container to the stable condition, the pressure differential during said return being sufficient to force said valve member to its closed valve position;

said valve member and housing including valve locking means for axially locking said member in the closed valve position in one annular position of the member about the axis and for releasing said valve member in a second different annular position.

9. The closure of claim 8 wherein said housing cavity has a bore aligned with said seat on said axis, said stem passing through said bore, at least one annular rib extending radially inwardly from said housing in said bore for sealingly engaging said stem and for guiding said stem.

10. The closure of claim 9 wherein said at least one annular rib includes a plurality of ribs in axially spaced position in said bore for guiding said stem during displacement of the valve to the open and closed valve states.

11. The closure of claim 9 wherein said ribs define a cylindrical bore and said stem has a circular cylindrical peripheral surface engaged with said ribs.

12. The closure of claim 8 wherein said handle knob and said housing each having an outer peripheral surface formed with serrations and mating indicia for identifying said open and locked positions.

13. The closure of claim 8 wherein the member has opposing sides on said axis, said housing including a chamber on one side of said member and an orifice on the other side of said member, said orifice for fluid communication with said interior and said interface, said cavity having a chamber aligned with and in fluid communication with said transverse conduit, said chamber having a sloping upper wall which at one angular position is closer to said member than at a second different angular position, said member including an upstanding ridge which engages said upper wall in said one position to force and lock the member in the closed valve position and which engages and abuts said upper wall in said second position when said member is in the open valve position to form said limiting means.

14. A closure for a squeezable container comprising:

a housing having a cavity defining an axis and a bore in fluid communication with the ambient atmosphere along the axis and with the cavity;

means for securing the housing to said container;

a tapered annular valve seat defining a fluid aperture and located in said cavity with the seat smaller circumferential dimension adjacent to said means for securing;

an annular valve member including a cylindrical portion and having a valve surface with smaller and relatively larger axially spaced circumferential dimensions for displacement within the cavity and mating with said seat for closing the aperture in one axial position and opening the aperture via the interface between the valve surface and the seat in a second axial position, a circular cylindrical stem secured to said valve member cylindrical portion and sealingly engaged with said housing in said bore for axial displacement in said bore;

a first fluid conduit in said cylindrical portion transverse said axis in fluid communication with said cavity intermediate the valve surface and stem;

a second central fluid conduit in said valve member extending along said axis for fluid coupling the transverse conduit to the ambient atmosphere through said stem;

a chamber in said housing having an upper wall and into which chamber said valve member and cylindrical portions are disposed;

said cylindrical portion being connected to said valve member adjacent to said greater dimension, said stem having a dimension transverse the axis less than the diameter of said cylindrical portion to form a shoulder on said portion facing said upper wall;

said chamber upper wall being positioned to engage said shoulder when the member is axially displaced from said seat to limit the displacement of said member away from said seat to provide an interface clearance between said chamber and said seat which permits fluid from said container to flow through said interface and which interface clearance is sufficiently small to permit said fluid when not under pressure and in said interface to form a continuous annular fluid volume in contact with and around said seat and said valve surface to form a fluid seal therebetween in the open valve position whereby ambient pressure when greater than the interior pressure forces said valve member axially into said seat to the closed valve position.

15. A closure for dispensing a fluid stored in a squeezable resilient container comprising:

a housing having a valve cavity, said cavity having an inlet conduit at a distal housing end, an intermediate valve chamber and a stem receiving bore at a housing proximal end all defining an axis, said valve chamber having an upper ceiling wall adjacent to said bore;

means for securing the housing in fluid communication with the container interior;

a frusto-conical valve seat in said chamber;

a valve member on said axis rotatably secured to the housing for rotation about said axis and including a valve adjacent the distal end for mating with said valve seat at an interface therebetween, a cylindrical portion in said chamber adjacent to said valve and medial the valve member along said axis and a stem in said bore extending from said cylindrical portion along said axis to said proximal end, said valve member having a bottom surface, said valve having a valve surface complementary to said seat for providing a substantially fluid tight seal in a seated closed valve position at the interface therebetween and an open valve position axial displaced from said seat, said valve stem having a top portion in communication with the ambient atmosphere at said proximal end;

a handle knob secured to said valve stem top portion external the housing for manual gripping by a plurality of fingers for rotating said stem about the axis, said handle overlying said valve stem and a portion of said housing;

said interface for being positioned in fluid communication with said stored fluid so that fluid forced against said bottom surface axially displaces said valve member to the open valve position along said axis and said fluid enters into and substantially forms a seal with said interface;

said valve member having a fluid receiving conduit transverse to said axis in said cylindrical portion in fluid communication with said chamber and interface, and a vertical central fluid discharge conduit passing through said valve stem and said handle from said fluid receiving conduit along said axis to the ambient atmosphere;

a shoulder on said valve member including a ridge extending in an axial direction along the axis toward said proximal end for selectively engaging the ceiling wall to limit the distance said valve member is permitted to axially displace to an open valve position from the closed valve position in a first angular position of said valve member about the axis to form said seal, said ridge for selectively engaging the ceiling wall in a second angular position of the valve member about the axis for axially locking the valve in a closed valve state; and said housing including at least one valve stem sealing rib formed one piece and integral with the housing and located in said stem receiving bore for guiding the stem during displacement along said axis and for fluid sealing said stem to said housing in said stem receiving bore.

* * * * *